US008192567B2

(12) United States Patent
Heister et al.

(10) Patent No.: US 8,192,567 B2
(45) Date of Patent: Jun. 5, 2012

(54) COMPOSITE SOLID ROCKET PROPELLANT WITH DCPD BINDER

(75) Inventors: Stephen D. Heister, West Lafayette, IN (US); Benjamin L. Austin, Jr., West Lafayette, IN (US); Jeremy Corpening, Spartanburg, SC (US)

(73) Assignee: Purdue Research Foundation, West Lafayette, IN (US)

( * ) Notice: Subject to any disclaimer, the term of this patent is extended or adjusted under 35 U.S.C. 154(b) by 1054 days.

(21) Appl. No.: 12/098,702

(22) Filed: Apr. 7, 2008

(65) Prior Publication Data

US 2011/0073224 A1 Mar. 31, 2011

Related U.S. Application Data

(60) Provisional application No. 60/910,649, filed on Apr. 7, 2007.

(51) Int. Cl.

| | |
|---|---|
| ***C06B 45/06*** | (2006.01) |
| ***C06B 39/00*** | (2006.01) |
| ***C06B 39/02*** | (2006.01) |
| ***C06B 39/04*** | (2006.01) |
| ***C06B 33/00*** | (2006.01) |
| ***D03D 23/00*** | (2006.01) |
| ***D03D 43/00*** | (2006.01) |

(52) U.S. Cl. ..... 149/32; 149/18; 149/29; 149/31; 149/37; 149/109.4

(58) Field of Classification Search ..... 149/18, 149/29, 31, 32, 37, 109.4
See application file for complete search history.

(56) References Cited

U.S. PATENT DOCUMENTS

| | | | | |
|---|---|---|---|---|
| 4,507,453 | A | 3/1985 | Tom | |
| 4,889,571 | A * | 12/1989 | Willer et al. | 149/19.9 |
| 4,915,754 | A * | 4/1990 | Hightower et al. | 149/19.4 |
| 5,288,805 | A * | 2/1994 | Kodali | 525/190 |
| 6,383,319 | B1 | 5/2002 | Humble et al. | |
| 6,740,180 | B1 * | 5/2004 | Cesaroni | 149/19.91 |
| 6,912,839 | B2 | 7/2005 | Kline et al. | |
| 7,022,196 | B2 | 4/2006 | Cesaroni et al. | |
| 7,108,758 | B1 | 9/2006 | Fallis et al. | |
| 2003/0024617 | A1 * | 2/2003 | Reed et al. | 149/19.4 |

OTHER PUBLICATIONS

Humble, Ronald W., "Dicylclopentadiene: A New Resin System for Making Composite Tank Structures," 36th AIAA/ASME/SAE/ASEE Joint Propulsion Conference and Exhibit, Jul. 16-19, 2000, Huntsville, AL.

Victor, A.C., "Insensitive Munitions Technology for Tactical Rocket Motors," Chapter 9 of the book *Tactical Missile Propulsion*, AIAA Astronautics and Aeronautics Series, pp. H-1-H-77, 1996.

* cited by examiner

*Primary Examiner* — James McDonough
(74) *Attorney, Agent, or Firm* — John V. Daniluck; Cedric A. D'Hue; Bingham Greenebaum Doll LLP

(57) ABSTRACT

A composite solid rocket propellant comprising a fuel, an oxidizer and a dicyclopentadiene binder is provided. The dicyclopentadiene binder may be mixed with the fuel and oxidizer as a monomer and then polymerized after mixing to form the composite solid propellant. The composite solid propellant may also comprise plasticizers, triphenylphosphine, lecithin or combinations thereof. Methods for making the composite solid rocket propellant of the present invention are also provided.

4 Claims, No Drawings

COMPOSITE SOLID ROCKET PROPELLANT WITH DCPD BINDER

RELATED APPLICATIONS

This application claims the benefit of U.S. Provisional Patent Application Ser. No. 60/910,649, filed Apr. 7, 2007, the complete disclosure of which is expressly incorporated herein by this reference.

This invention was made in part with Government support under Contract No. HQ0006-06-C-7513 awarded by the Missile Defense Agency. The Government has certain rights in this invention.

TECHNICAL FIELD

The present invention is related generally to composite solid rocket propellants, and particularly to composite solid rocket propellants having polymerized binders.

BACKGROUND OF THE INVENTION

Solid rocket composite propellants typically comprise metallic fuels and chemical oxidizing agents immobilized in polymeric binders. When these components are mixed together, they chemically react and release large amounts of energy. This released energy creates an interior pressure, which is sufficient for thrusting a rocket motor into propelled flight.

To maintain structural integrity of propellants during operation and storage, as well as to enhance tensile strength, selecting an appropriate propellant binder is important, particularly as these propellants typically have very complex microstructures consisting of densely packed particles. These particles may include fuel, oxidizers, combustion control agents, as well as other added ingredients, which provide additional energy performance, improved mechanical properties and/or simplified processing techniques.

Insensitive munitions ("IM") are defined as munitions that fulfill their performance, readiness and operational requirements reliably and on-demand, yet these munitions have a minimized probability of inadvertent initiation and severity of subsequent collateral damage to weapons platforms, logistic systems and personnel when subjected to unplanned stimuli. While it is generally understood that all propellants will have some degree of sensitivity, it is important to minimize this sensitivity, as well as to minimize the associated reaction violence of the propellant during combustion. To accomplish this, it is desirable to use solid propellant binder systems, which exhibit favorable structural and insensitive munition characteristics, as well as exhibit favorable combustion pressure and ignition limits, storage and thrust performance characteristics and burning rates.

There is an ongoing need for, and interest in, designing advanced materials for IM improvements in tactical, strategic and commercial solid rocket applications, as well as a need to simplify manufacturing processes, reduce associated costs and improve IM response efforts. The present invention is intended to address one or more of these problems.

SUMMARY OF THE INVENTION

According to one aspect of the present invention, a composite solid rocket propellant is provided. The propellant comprises an oxidizer, a fuel, and a dicyclopentadiene binder. According to this aspect of the present invention, the dicyclopentadiene binder may be mixed with the oxidizer and the fuel as a monomer and then polymerized after mixing to form a composite solid propellant. In addition, the composite solid rocket propellant may also comprise additional ingredients, such as plasticizers, triphenylphosphine, lecithin or combinations thereof.

According to another aspect of the present invention, a composite solid rocket propellant comprising from about 70% to about 90% by weight of a fuel and an oxidizer combined, and from about 10% to about 30% of a dicyclopentadiene binder is provided.

According to yet another aspect of the present invention, a method for producing a solid rocket propellant comprising mixing a dicyclopentadiene binder with a fuel, an oxidizer and a catalyst is provided. According to this aspect of the invention, the dicyclopentadiene binder is in liquid form.

DETAILED DESCRIPTION

The illustrative embodiments of the present invention described below are not intended to be exhaustive or to limit the invention or its teachings to the precise forms disclosed in the following detailed description. Rather, the embodiments are chosen and illustratively described so that others skilled in the art may appreciate and understand the principles and practices of the present invention. The illustrated embodiments provided within the detailed description represent the best currently contemplated modes of carrying out the invention and are not intended to be taken in a limiting sense. As such, the illustrative embodiments of the present invention are provided merely to illustrate the general principles of the invention.

The present invention relates generally to the use of composite solid rocket propellants and methods for making such propellants. In general, the solid rocket propellants of the present invention comprise an oxidizer, a fuel and a binder. According to certain aspects of the present invention, the binder can be a polymerized binder that forms a high-strength polymer capable of binding solids effectively into a high strength matrix. In addition, the polymerized binders may also have hardness and failure stress characteristics which are substantially higher than traditional propellants, such as, but not limited to, hydroxyl-terminated polybutadiene (HTPB) and polybutadiene/acrylonitrile/acrylic acid terpolymer (PBAN) based propellants.

According to one illustrative aspect of the present invention, the composite solid rocket propellant comprises a polymerized binder, such as a dicyclopentadiene ("DCPD") binder. In accordance with this illustrative aspect, the DCPD binder can be present in an amount of from about 10% to about 30% by weight of the composite solid propellant. Moreover, the DCPD binder may be mixed with the oxidizer and the fuel as a low viscosity liquid and then polymerized to form a composite solid fuel upon curing.

According to one aspect of the present invention, the composite solid propellant can include a fuel such as, but not limited to, aluminum, boron and magnesium. Moreover, such fuels may have particle sizes of from about 0.01μ to about 20μ.

In certain aspects of the present invention, the composite solid propellant may also comprise an oxidizer such as, but not limited to, ammonium perchlorate, ammonium nitrate and potassium perchlorate. In certain embodiments in which the oxidizer is ammonium perchlorate, the ammonium perchlorate may be present in a fine and/or coarse form. Fine ammonium perchlorate may have a particle size of from about 50μ to about 150μ while coarse ammonium perchlorate may have a particle size of from about 150μ to about 250μ. The composite solid propellant may comprise from about 70% to about 90% by weight of the fuel and the oxidizer combined. In an illustrative embodiment, the composite solid propellant comprises from about 80% to about 85% by weight of the fuel and the oxidizer combined.

In one aspect of the present invention, the composite solid propellant may comprise a catalyst for polymerizing the binder. While it should be understood and appreciated that various catalysts known to those skilled within the art may be useful for polymerizing the present binders, in certain illustrative embodiments herein, the catalyst may include, but is not limited to, a ruthenium-based catalyst, a tungsten-based catalyst and a molybdenum-based catalyst.

In certain embodiments in accordance with the present invention, the catalyst may be a ruthenium-based transition metal carbene complex, such as a Grubbs $1^{st}$ or $2^{nd}$ Generation Catalyst. In embodiments in which a Grubbs $1^{st}$ Generation Catalyst is used, the catalyst may be useful for producing a low temperature reaction. Moreover, in certain aspects of the present invention triphenylphosphine ("TPP") may be used with the catalyst to aid in controlling the polymerization rate. While the catalyst may be present in any amount that is sufficient to cause the desired degree of polymerization of the DCDP binder, according to certain illustrative embodiments, the catalyst is present in an amount of from about 0.01% to about 0.02% by weight of the composite solid rocket propellant.

The composite solid propellant of the present invention may further comprise other additive elements, which may provide additional energy performance characteristics, improved mechanical properties and/or simplified processing techniques. These additional ingredients may include, but are not limited to, plasticizers, lecithin, and triphenyl phosphine. In certain aspects of the present invention, a plasticizer may be added in an amount of from about 0% to about 9% by weight of the composite solid propellant to give the propellant some elasticity by modifying the structural characteristics of the propellant (e.g., such as modifying strain to failure capability), as well as to improve low-temperature performance and reduce brittleness, particularly as such characteristics can be present at very low temperatures. Non-limiting examples of plasticizers useful in accordance with the present invention include, but are not limited to, 2-ethylhexyl acrylate (EHA), dioctyl sebacate (DOS) dioctyl phthalate (DOP), polybutylene, polyisobutalyne, polyisoprene, polybutadiene, dibutyl phthalate (DBP), dioctyl adipate (DOA), dioctyl maleate (DOM) or combinations thereof.

It should be understood and appreciated herein that in embodiments in which the composite solid rocket propellants include lecithin as an additive ingredient, such ingredient may be useful for reducing the viscosity of the propellant thereby making it easier to mix ingredients into the composite. Moreover, in embodiments in which triphenyl phosphine is added, it may be useful for increasing the polymer setting time.

The present invention also provides a method for making a composite solid rocket propellant with a DCPD binder. According to certain aspects of the present invention, the method may comprise mixing a DCPD monomer with a fuel, an oxidizer and a catalyst. In some aspects, the DCPD monomer may be filtered and sparged before being added to the other components of the propellant. Moreover, in certain illustrative aspects of the present invention, the DCPD binder of the propellant composite may be maintained at a temperature of from about 35° C. to about 40° C. In yet more specific aspects of the present invention, the DCPD monomer may be maintained at a temperature of at least about 35° C. to keep the monomer in liquid form. The liquid DCPD may then be filtered through solid aluminum oxide or silica powder in a filter funnel. The DCPD may then continuously be filtered until no particulate matter is visible. After filtration, the liquid DCPD monomer may be sparged with an inert gas such as, but not limited to, argon.

After the DCPD monomer is filtered and sparged, the catalyst may be added to and dissolved in the liquid DCPD monomer. Alternatively, the catalyst may be dissolved in a compatible solvent and then added to the DCPD monomer. After adding the catalyst to the DCPD binder, the mixture may be added to the combined aluminum powder and ammonium perchlorate solids. It may be desirable to maintain a temperature of at least about 35° C. so that the DCPD will remain in the liquid state until polymerized. In one embodiment, the liquid DCPD/catalyst mixture may be added to a mixture of aluminum powder and coarse ammonium perchlorate. After mixing, additional fine ammonium perchlorate can be added stepwise until the desired amount has been added. When all the components of the solid fuel have been mixed, the mixture may be cast so that the DCPD polymerizes and the propellant solidifies.

As explained above, in certain aspects of the present invention, other components and/or ingredients may also be added to the liquid DCPD before being mixed with the solids. Such components may include one or more plasticizers, triphenyl phoshine, lecithin, or mixtures thereof.

Advantages and improvements of the composites and methods of making the composites of the present invention are demonstrated in the following example. This example is illustrative only and is not intended to limit or preclude other embodiments of the present invention.

EXAMPLE 1

Table 1 shows illustrative chemical supplies and laboratory equipment that can be used to formulate the composite solid rocket propellants of the present invention.

TABLE 1

| Supplies-Chemicals (Per propellant mix data sheet) |
|---|
| Dicyclopentadiene (DCPD) monomer in a clear liquid form and which freezes at room temperature |
| Aluminum Powder in gray powder (micron) form |
| Ammonium Perchlorate in bimodal blend particle sizes |
| Grubbs $1^{st}$ Generation Catalyst stored at about 8° C. and in dark purple powder form |
| Triphenyl-phosphine (TPP) in a small crystalline structure and similar to the appearance of table salt |
| Aluminum Oxide (AlOx) in fine off-white to yellow power form |
| Lecithin in viscous liquid form similar to honey |
| 2-ethylhexyl acrylate (EHA) |
| Tepanol |
| Toluene |
| Acetone |
| Mold release |
| Green Cleaning Solution |
| Scotchbrite |
| Supplies-Laboratory Equipment |
| Glove Box to provide an oxygen and moisture free environment for catalyst transfer |
| Vacuum source with valve to adjust level of vacuum |
| Argon source used during DCPD bubbling |
| Bubble wand |
| Scale accurate to 0.0001 grams |
| Assorted glass beakers and flasks |
| Ceramic filter with an air-tight stopper |
| Numerous 1 gram air-tight vials |
| Heating and magnetic mixing device within a stirring bar |

TABLE 1-continued

| |
|---|
| Disposable pipettes |
| Small wax paper squares |
| Filter paper |
| Disposing gloves |
| Tongue depressors for hand mixing |
| Paper towels |
| Safety glass |
| Lab coat |
| Conductive heel straps (1 pair per person) |
| Paper cups |
| Brown paper roll for protection of work surfaces |
| Four (4) 5-gallon buckets |
| Two (2) stop watches |

It should be noted that mixer pre-operation examination procedures should be carried out prior to working with any ingredients if mixing is to be carried out using a Ross mixer setup.

After performing any necessary mixer pre-operation examination procedures, DCPD filtering and sparging is conducted. In this step, the entire bulk container of the clear DCPD binder monomer is placed into an oven set between about 35° C. to about 40° C. (about 95° F. to about 104° F.) to avoid freezing. After being placed in the oven, the DCPD binder should be checked in about 15 minutes. It should also be noted that it may be beneficial to warm the glassware and ceramic funnel.

Once the DCPD binder is warmed (unfrozen), it is poured into a warm glass beaker. For this step, the volume of the DCPD required may be calculated by using its density (1.07 g/cc) and then pouring triple that amount into the warm glass beaker. A fair amount of DCPD may be lost during filtering and may also freeze to the sides of the container. In addition, the bulk DCPD container should be allowed to cool before being returned to storage.

After the DCPD is poured into the beaker, it is placed on a heating device to avoid freezing. To accomplish this, the beaker is keep at a temperature just above about 100° F.

Next, the ceramic funnel with the air-tight stopper is inserted into the top of a flask having a vacuum connection, and one piece of filter paper is inserted into the ceramic funnel. The ceramic funnel is filled about halfway with warm Aluminum Oxide powder. A vacuum line is then attached to the flask, and a small amount of the warm DCPD is poured into the top of the ceramic funnel to wet the Aluminum Oxide.

The vacuum source is turned on and the valve slowly opened. Essentially, the vacuum source should be adjusted so that the DCPD slowly pulls through the Aluminum Oxide and drips into the flask. Thereafter, the remaining warm and unfiltered DCPD is poured through the Aluminum Oxide until it has all been filtered.

Next, the filtered DCPD flask is placed onto a heating device. It should be noted that some Aluminum Oxide particles may be visible in the filtered DCPD. Acetone is then used to thoroughly clean and remove all the Aluminum Oxide from the ceramic funnel. To this end, it should be noted that removing the Aluminum Oxide from the ceramic funnel may be done by using a second flask to pull vacuum and suck acetone through the ceramic funnel.

Once the ceramic funnel is clean of the Aluminum Oxide, the funnel is placed in a third flask having an air-tight stopper and an attached vacuum source. One piece of filter paper is then inserted into the ceramic filter. Aluminum Oxide should not be used for this second filter.

The warm and once filtered DCPD should then be slowly poured into the ceramic filter and the vacuum source valve adjusted so that the DCPD slowly begins to drip into the flask. After this second filtering, the DCPD should be inspected to be sure that all of the Aluminum Oxide particles have been removed. If Aluminum Oxide particles are still visible, the filtering step should be repeated by using only filter paper.

Once the filtering process is completed, the DCPD is poured from the flask back into the beaker and placed back on the heating device to avoid freezing. While the DCPD beaker is resting on the heating device, a bubble wand and Argon supply can be prepared. More particularly, the bubble wand is placed into the warm and filtered DCPD, while the Argon supply is slowly opened. The Argon is allowed to bubble through the DCPD for at least about 20 minutes. It should be noted that the bubble wand should be stirred inside the DCPD to avoid freezing in and around the wand.

After these DCPD preparation steps, the DCPD is now ready for mixing with the solids. To accomplish this, the glassware should be cleaned with a cleaning solution (e.g., Simple Green solution) and water then hand washed using dish soap. Next, a mixture of acetone and DCPD is poured into a dedicated disposal jug. Finally, the glassware should be dried in the oven or on a table top.

Regarding the removal and handling of the Grubbs 1$^{st}$ Generation Catalyst, it should be stored under an oxygen and moisture free environment and at or near about 0° C.; otherwise, it will turn from its dark purple color to rust brown. If the catalyst is rust brown, it should not be used. It should also be noted that distribution of bulk catalyst to batch vials must be done in an inert atmosphere in the glove box.

Steps for mixing the DCPD and solids with a Ross Mixer in accordance with this illustrative example of the present invention are now discussed. First, it should be noted that plastic scrapers can be wiped clean with acetone. Moreover, used glassware, mixer bars, etc. can be cleaned with Simple Green cleaning solution and hot deionized water to make cleanup of these items as easy as possible.

To clean each item after use, a 5-gallon gallon bucket can be filled with Simple Green cleaning solution and warm water, two 5-gallon buckets filled with hot water and a final bucket filled with warm deionized water.

The required amounts of ingredients are calculated and recorded on the mixing sheet before proceeding. Moreover, the jacket water should also be at a desired temperature before proceeding.

Next, the required amount of DCPD is weighed and recorded on a mix data sheet as ($m_{DCPD}$) and the required amount of TPP is weighed on a wax paper square and recorded. The TPP is then poured into the DCPD, which is still on the hot plate. A stirring bar is placed in the DCPD and turned to a low stir level. It should be noted that the TPP should be fully dissolved in the DCPD before moving to the next step.

The required amounts of Lecithin (e.g., about 0.5% by weight of the total mixture), EHA (e.g., about 3.8% by weight of the total mixture) and Tepanol (e.g., about 0.45% by weight of the total mixture) are each weighed in a paper cup and their respective values recorded on the mix data sheet. After being weighed, the Lecithin, EHA and Tepanol are poured into the DCPD with the stirring bar operational. The components are allowed to mix for about 5 minutes.

After mixing, one small 1 gram vial of Grubbs 1$^{st}$ Generation Catalyst should be removed from the refrigeration unit. Once removed, it is weighed on a wax paper square and its value recorded on the mix data sheet.

If necessary, a second 1 gram vial of the Grubbs 1$^{st}$ Generation Catalyst can also be removed from the refrigeration unit and weighed. To this end, if not all of the Grubbs 1$^{st}$ Generation Catalyst is needed from the second vial, a cap can be placed on the vial and it placed back into the refrigerator separate from other unopened vials. This will help separate the vials that have been exposed to the atmosphere from the vials that are under argon storage (unopened vials).

The required amount of Grubbs 1st Generation Catalyst should be put in one of the 1 gram air-tight vials. Next, using a disposable pipette, a few drops of toluene should be transferred into the vial with the catalyst. It should be noted that enough toluene (but not too much) should be used to thoroughly dissolve the catalyst.

The vial is then sealed and the toluene/catalyst mixture shook/agitated until the catalyst appears to be dissolved. At this point, a required amount of Aluminum powder, Ammonium Perchlorate (large particle size) and Ammonium Perchlorate (small particle size) are weighed and the toluene/catalyst mixture added to the DCPD mixture in the beaker. After mixing with the stirring bar for about 5 minutes, the mixing bowl is lowered locally and the Aluminum power and coarse Ammonium Perchlorate added into the mixing bowl. The DCPD mixture should be poured over the Aluminum powder and Ammonium Perchlorate powder in such a manner that the powders are thoroughly wet.

The mix cycle is carried out for about 5 minutes at a mix speed of about 30 Hz. The mix cycle can be repeated for an additional 5 minutes if the contents in the bowl are not thoroughly mixed. However, once they are mixed, about half (½) of the fine Ammonium Perchlorate should be added to the mixing bowl and another mix cycle initiated (i.e., mix for about 5 minutes at a mix speed of about 30 Hz). As with the first mix cycle, if the contents are not thoroughly mixed, the mixing step should be repeated for another 5 minutes.

Once the contents have been sufficiently mixed according to the second mixing cycle, the remainder of the fine Ammonium Perchlorate should be added to the mixing bowl and mixed according to the same steps explained above. After the final addition of the Ammonium Perchlorate has been mixed into the bowl contents, the operator can proceed to the casting process.

It should be understood and appreciated herein that the mixing steps illustrated above may be alternatively performed manually rather than with a Ross Mixer. According to this aspect of the illustrative example, the required amounts of ingredients should be calculated and recorded on the mixing sheet before proceeding. Moreover, the required amount of DCPD is weighed and recorded on a mix data sheet as ($m_{DCPD}$) and the required amount of TPP is weighed on a wax paper square and recorded. The TPP is then poured into the DCPD, and a stirring bar is placed in the DCPD and turned to a low stir level. It should be noted that the TPP should be fully dissolved in the DCPD before moving to the next step.

The required amounts of Lecithin (e.g., about 0.5% by weight of the total mixture), EHA (e.g., about 3.8% by weight of the total mixture) and Tepanol (e.g., about 0.45% by weight of the total mixture) are each weighed in a paper cup and their respective values recorded on the mix data sheet. After being weighed, the Lecithin, EHA and Tepanol are poured into the DCPD with the stirring bar operational. The components are allowed to mix for about 5 minutes.

After mixing, one small 1 gram vial of Grubbs 1st Generation Catalyst should be removed from the refrigeration unit. Once removed, it is weighed on a wax paper square and its value recorded on the mix data sheet.

If necessary, a second 1 gram vial of the Grubbs 1st Generation Catalyst can also be removed from the refrigeration unit and weighed. To this end, if not all of the Grubbs 1st Generation Catalyst is needed from the second vial, a cap can be placed on the vial and it placed back into the refrigerator separate from other unopened vials. This will help separate the vials that have been exposed to the atmosphere from the vials that are under argon storage (unopened vials).

The required amount of Grubbs 1st Generation Catalyst should be put in one of the 1 gram air-tight vials. Next, using a disposable pipette, a few drops of toluene should be transferred into the vial with the catalyst. It should be noted that enough toluene (but not too much) should be used to thoroughly dissolve the catalyst.

The vial is then sealed and the toluene/catalyst mixture shook/agitated until the catalyst appears to be dissolved. Next, the toluene/catalyst mixture is poured into the DCPD/TPP/additives with the stirring bar operational. After mixing with the stirring bar for about 5 minutes, the required amount of Aluminum powder is weighed and then mixed into the DCPD using the mixing rod. The mixing process should be started slowing and then increased in speed as the mix allows.

The required amount of Ammonium Perchlorate should then be weighed and then added to the beaker as the mixing rod stirs. The mix should then be poured into a plastic baggy and small amount of Ammonium Perchlorate added and mixed by creating high shear with the operator's fingers on the outside of the baggy. The Ammonium Perchlorate should be continually added to the mixture until it becomes clay-like in viscosity. At this point, the remaining amount of Ammonium Perchlorate should be weighed and recorded. It should be noted that in some mixing processes, all of the Ammonium Perchlorate will be mixed, whereby none will remain for weighing and recording. Once thoroughly mixed, the mixture is ready to be cast into the desired mold.

While exemplary embodiments incorporating the principles of the present teachings have been disclosed hereinabove, the present teachings are not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

What is claimed is:

1. A composite solid rocket propellant comprising: from about 70% to about 90% by weight of a fuel and an oxidizer combined; and from about 10% to about 30% of a dicyclopentadiene binder from about 0.02% to about 0.04% by weight triphenylphosphine; and from about 0% to about 9% of a plasticizer.

2. The composite solid rocket propellant of claim 1, wherein the fuel is selected from aluminum, boron, magnesium or combinations thereof.

3. The composite solid rocket propellant of claim 2, wherein the fuel has particle sizes from about 0.01 μm to about 20 μm.

4. The composite solid rocket propellant of claim 1, wherein the oxidizer is ammonium perchlorate, ammonium nitrate, potassium perchlorate or combinations thereof.

* * * * *